US005769732A

United States Patent [19]

O'Neal

[11] Patent Number: 5,769,732

[45] Date of Patent: Jun. 23, 1998

[54] GOLF TRAINING AID

[76] Inventor: James Edward O'Neal, 70 Canning Rd., Saranac, N.Y. 12981

[21] Appl. No.: 713,041

[22] Filed: Sep. 12, 1996

Related U.S. Application Data

[63] Continuation-in-part of Ser. No. 679,456, Jul. 9, 1996, abandoned.

[51] Int. Cl.[6] ..... A63B 69/36

[52] U.S. Cl. ..... 473/258; 473/273

[58] Field of Search ..... 473/257, 258, 473/259, 229, 260, 273; 273/191 R, 191 A, 191 B, 192

[56] References Cited

U.S. PATENT DOCUMENTS

| | | | |
|---|---|---|---|
| 3,583,707 | 6/1971 | Fusimoto . | |
| 3,953,035 | 4/1976 | Beckish . | |
| 3,975,024 | 8/1976 | Stephan | 473/287 X |
| 4,040,633 | 8/1977 | Sciarrillo . | |
| 4,900,030 | 2/1990 | Houtz . | |
| 4,928,975 | 5/1990 | Skelley et al. . | |
| 4,998,731 | 3/1991 | Bowen . | |
| 5,273,284 | 12/1993 | Montgomery | 473/268 X |
| 5,332,211 | 7/1994 | Rife et al. . | |
| 5,423,548 | 6/1995 | Bricker . | |
| 5,433,445 | 7/1995 | Melancon . | |

FOREIGN PATENT DOCUMENTS 406170026 6/1995 Japan .

*Primary Examiner*—George J. Marlo

*Attorney, Agent, or Firm*—Law Offices of Richard L. Sampson

[57] ABSTRACT

A golf training aid is provided which includes a generally rectangular base configured for supportive contact with a ball playing surface. Posts or support members extend from the base and support first and second cross-bars. The first and second guide members each have a shaft guiding surface and a support surface disposed on opposite sides thereof. Each of the first and second guide members are supported by the base at the support surface so that each of the shaft guiding surfaces extends in a substantially unobstructed manner along substantially the entire length of the first and second guide members. The shaft guiding surfaces of the first and second guide members are adapted to guide a portion of the club shaft located proximate the club handle and a portion of the club shaft located proximate the club head along a notional surface defined by the shaft guiding surfaces of the first and second guide members. The first and second guide members are each movable in a direction generally parallel to the ball playing surface to selectively position the notional plane at selected angles of incline α relative to the ball playing surface. This movement selectively increases the distance between the first and second guide members as the selected angles of incline α decrease, while maintaining the first and second guide members at substantially uniform predetermined orthogonal distances from the ball playing surface.

19 Claims, 3 Drawing Sheets

10
12
14
16
18
19
20
21
22
22'
23
24
26
27
27'
28
29
30
32
a
b
d
s
p
α
α'
β
β'

GOLF TRAINING AID

This is a continuation-in-part of application Ser. No. 08/679456, filed Jul. 9, 1996, now abandoned.

BACKGROUND OF THE INVENTION

1. Field of the Invention

This invention relates to devices for aiding the practice of golf and more particularly, to an apparatus for practicing putting and chipping strokes.

2. Background Information

Over the years, many devices, systems and methods have been produced ostensibly for the purpose of improving one's golf game. Many of these have been directed towards improvement of a particular aspect of the game, such as the putting stroke. One device for aiding the practice of putting strokes may comprise a generally horizontally disposed bar or guide against which a user may slide the shaft of the golf club during practice strokes. The bar may thus help prevent the club from deviating from a preferred trajectory during practice to enable the user to learn the proper stroke through consistent repeated motion. An example of a device of this general type is disclosed in U.S. Pat. No. 4,900,030.

While such a device may facilitate practice of the putting stroke, it is not without significant drawbacks. In particular, the use of a single bar or guide provides only a single point of contact between the device and the shaft of the golf club. Such a single point of contact inherently provides a relatively unstable support to the club. The device thus tends to provide little resistance to the tendency of the club to undesirably pivot about the bar to various angles relative to the ball playing surface. One skilled in the art will recognize that occurrence of such pivotal movement during the swing introduces disadvantageous inconsistency and inaccuracy to the practice stroke.

In an effort to eliminate such pivotal motion during the stroke, it may be desirable to provide a pair of generally parallel bars or guides spaced from one another to provide a second point of contact with the shaft of the golf club. Furthermore, means may be provided to adjust the bars relative to one another to support the golf club shaft at various angles of incline relative to the playing surface. This adjustability may thus accommodate variations in club construction, namely, variations in shaft to head angles. An example of a double-bar device of this general type is disclosed in U.S. Pat. No. 4,928,975.

Although such double-bar devices may provide improved support and consistency of practice relative to the aforementioned single bar devices, they too have drawbacks. Many of these drawbacks are related to the adjustability of the angle of incline as mentioned hereinabove. In particular, reducing the angle of incline tends to either lower the bars relative to the user's hands, or move the bars closer to one another. In either instance, the proportion of the club shaft extending above an uppermost bar, and/or below the lowermost bar is effectively increased to effectively increase the moment arm or leverage exerted against the device by either end of the club. This increase in moment arm increases the tendency of the club to disadvantageously rock or otherwise become disengaged from one or both of the bars upon deviation of the user's hands from the preferred swinging movement.

This problem is exacerbated in the event a user attempts to utilize the device in cooperation with a club having a relatively large shaft to head angle. In such an instance, the extra shaft length necessitated by the greater shaft to head angle creates an even greater moment arm and thus an even greater tendency for the club to rock relative to the device and disadvantageously reduce the consistency and accuracy of the practice strokes.

A further disadvantage of some devices of this type is that the bars or guides may inadvertently be moved into non-parallel alignment with one another during the course of adjusting the angle of incline. Disadvantageously, such misalignment may tend to introduce a curvature to the practice stroke and/or promote what is commonly referred to as an "outside to in" or "inside to out" stroke.

Thus, a need exists for an improved golf training aid which provides improved support to a golf club throughout a range of angles of incline to a ball playing surface.

SUMMARY OF THE INVENTION

According to an embodiment of the present invention, a golf practice device is provided for use with a golf club having a shaft extending between a handle and a head. The golf practice device includes a base adapted for supportive contact with a ball playing surface and first and second guide members supported by the base. The first and second guide members each have a shaft guiding surface and a support surface disposed on opposite sides thereof. Each of the first and second guide members are supported by the base at the support surface so that each of the shaft guiding surfaces extends in a substantially unobstructed manner along substantially the entire length of the first and second guide members. The shaft guiding surfaces of the first and second guide members are adapted to guide a portion of the club shaft located proximate the club handle and a portion of the club shaft located proximate the club head along a notional surface defined by the shaft guiding surfaces of the first and second guide members. At least one of the first and second guide members is adapted for selective movement within a predetermined range of movement so that the notional plane is positionable at selected angles of incline relative to the ball playing surface. This selective movement serves to selectively increase distance between the first and second guide members as the selected angles of incline decrease.

The above and other features and advantages of this invention will be more readily apparent from a reading of the following detailed description of various aspects of the invention taken in conjunction with the accompanying drawings.

DETAILED DESCRIPTION OF THE PREFERRED EMBODIMENTS

Figures 1, 2, 3, 4:
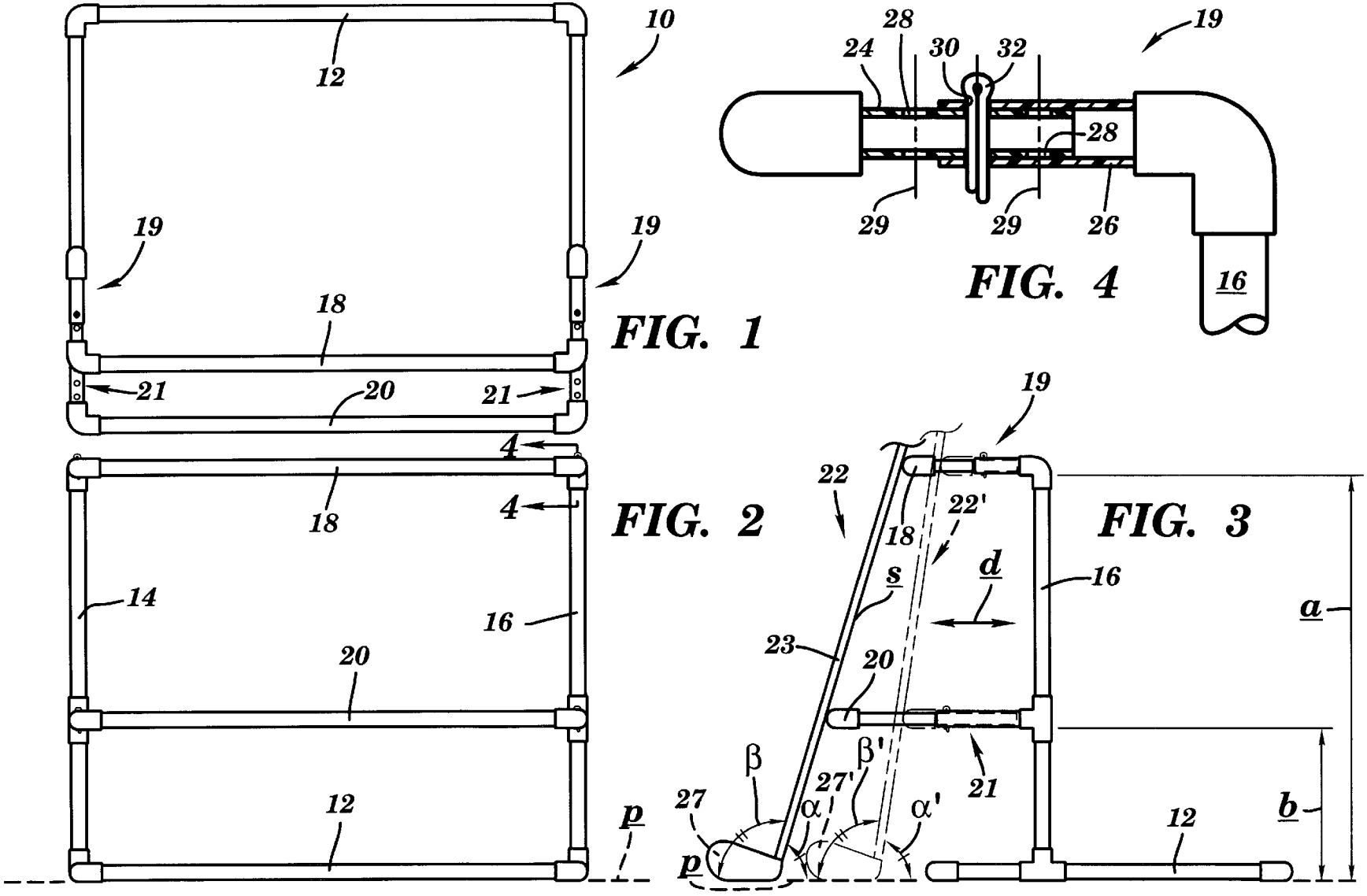
FIG. 1 is a plan view of the golf training aid of the subject invention.
FIG. 2 is an elevational front view of the golf training aid of FIG. 1.
FIG. 3 is an elevational side view of the golf training aid of FIG. 2 in use with a golf club, with portions of the golf training aid shown in phantom at alternate positions within a range of movement, in use with an alternate golf club shown in phantom.
FIG. 4 is an enlarged, partial cross-sectional view of the golf training aid taken along 4—4 of FIG. 2.
Figure 5:
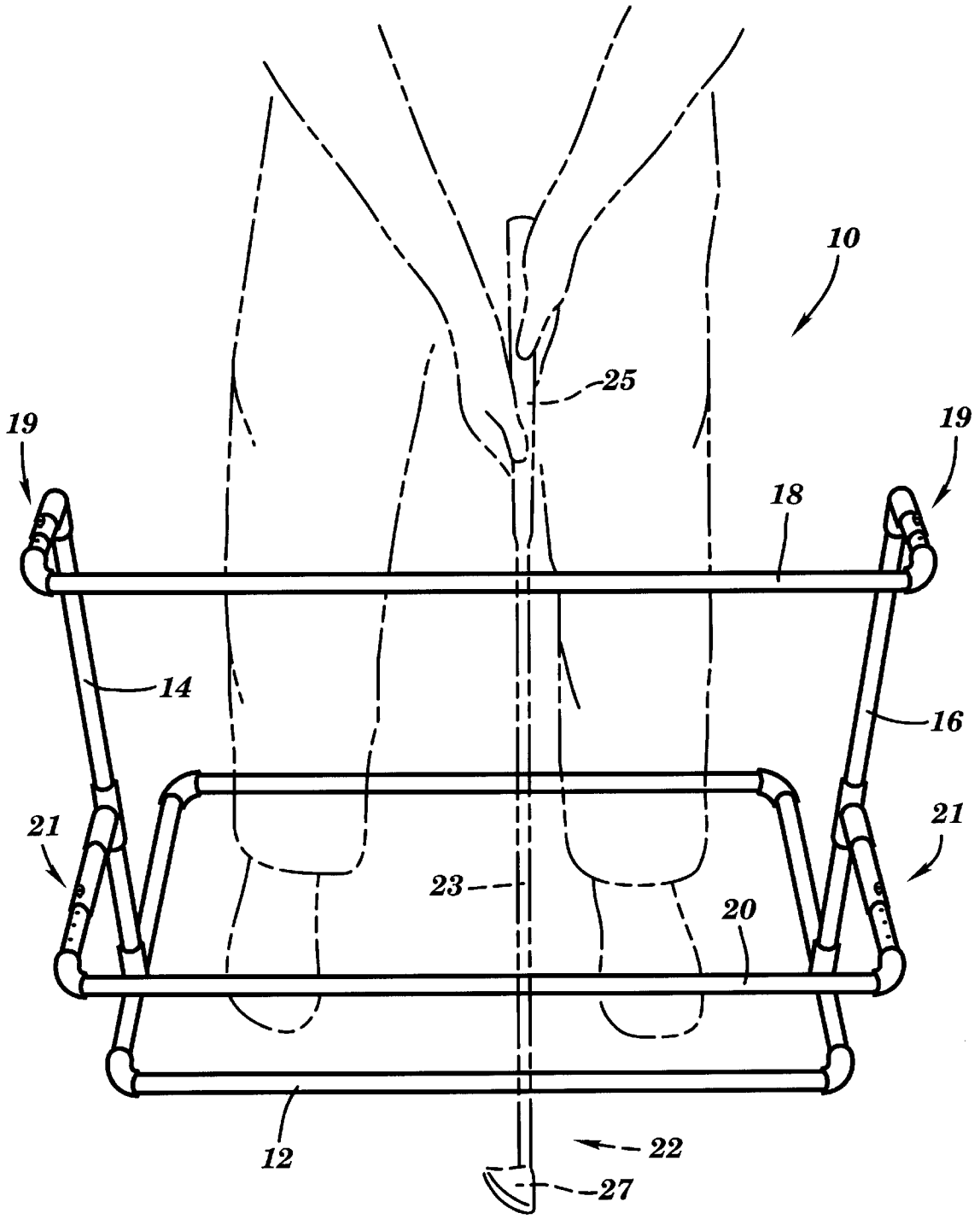
FIG. 5 is a perspective view of the golf training aid of FIG. 4, with a phantom representation of a golfer utilizing the training aid by sliding a golf club along the length of the guides thereof.

Briefly described, as shown in FIGS. 3 & 5, a golf training aid 10 of the present invention includes a generally rectangular base 12 configured for supportive contact with a ball playing surface. Posts or support members 14 and 16 extend from base 12 and support first and second cross-bars or guide members 18 and 20, respectively. First and second guide members 18 and 20 serve to guide a shaft 23 of a golf club 22 at locations on the shaft proximate the club handle 25 and proximate the club head 27, as shown in FIGS. 3 and 5. Shaft 23 is thus guided along a notional surface indicated at s in FIG. 3, defined by the first and second guide members.

The first and second guide members are each movable in directions generally parallel to the ball playing surface, or parallel to a plane p defined by base 12, as shown in FIG. 3, to selectively position the notional surface at selected oblique angles of incline α relative to plane p. This movement selectively increases the distance between first and second guide members 18 and 20 as the selected angles of incline α decrease, while maintaining the first and second guide members 18 and 20 at substantially uniform predetermined orthogonal distances a and b, respectively, from plane p.

Referring to the drawings in detail, as shown in FIGS. 1–3 & 5, golf training aid 10 includes a rigid, preferably rectangular base 12 which generally defines a plane p (FIGS. 2 & 3). The base is adapted to be placed in supportive contact with a ball playing surface wherein plane p is generally superimposed over the ball playing surface.

Posts or support members 14 and 16 extend a predetermined distance from opposite sides of base 12 in a direction preferably orthogonal to plane p. The posts each terminate at first fastener assemblies 19 which extend generally orthogonally therefrom, in a direction substantially parallel to plane p. A second fastener assembly 21 extends from a medial portion of each post 14 and 16 at a predetermined location between the base and each first fastener assembly 19. The second fastener assemblies each extend in a direction generally parallel to first fastener assemblies 19. In a preferred embodiment, as shown in FIGS. 3 & 5, each second fastener assembly 21 extends a predetermined distance further from each support member 14 and 16, respectively, than do first fastener assemblies 19, to generally orient notional surface s at an oblique angle of incline α to plane p, as will be discussed hereinafter. Additional details of a preferred configuration of fastener assemblies 19 and 21 will be discussed hereinafter with respect to FIG. 4.

First fastener assemblies 19 serve to movably support opposite ends of first guide member 18, and second fastener assemblies 21 serve to movably support opposite ends of second guide member 20. The first and second guide members are thereby selectively movable in directions generally parallel to plane p as indicated by arrow d in FIG. 3, to desired positions within predetermined ranges of movement. These predetermined ranges of movement are determined to facilitate use of training aid 10 in conjunction with a relatively wide variety of golf clubs 22 as will be discussed hereinafter. This construction thus serves to maintain first and second guide members 18 and 20 at substantially uniform predetermined orthogonal distances a and b, respectively, from plane p, throughout their predetermined ranges of movement, while selectively positioning notional surface s at a desired angle of incline α, within a predetermined range of angles of incline. In this regard, angle of incline α may be adjusted to be substantially complementary to an angle between shaft 23 and head 27 of a particular golf club 22 to be used in conjunction with the present invention, as indicated by shaft to head angle β in FIG. 3. An example of an alternate orientation of the training aid of the present invention is shown in phantom in FIG. 3, in which notional plane s may be disposed at alternate angle of incline α' to complement shaft to head angle β' of an alternate golf club 22'. This adjustability will be discussed in greater detail hereinafter with respect to the operation of the present invention. First and second fastener assemblies 19 and 21 also serve to maintain first and second guide members 18 and 20 in substantially parallel orientation relative to one another throughout their respective ranges of movement, as will also be discussed hereinafter.

As shown in FIGS. 3 & 5, first and second guide members 18 and 20 are adapted for being slidably engaged by a golf club 22 along a portion of shaft 23 located proximate or adjacent club handle 25 and a portion of shaft 23 located proximate or adjacent club head 27, respectively. The shaft is thus guided along notional surface s by the first and second guide members as shown in FIG. 3.

Referring now to FIG. 4, a preferred embodiment of first fastener assembly 19, as shown, is substantially identical to that of second fastener assembly 21, with the aforementioned exception that each second fastener assembly 21 extends a predetermined distance further from each support member 14 and 16, respectively, than do first fastener assemblies 19. In addition, first and second fastener assemblies 19 and 21 extending from first post 14 are substantially identical to those extending from second post 16. Accordingly, the following description of FIG. 4, relative to a first fastener assembly 19 extending from second post 16, should be understood by one skilled in the art to be applicable to a second fastener assembly 21 disposed on second post 16, as well as to first and second fastener assemblies disposed on first post 14.

As shown, first fastener assembly 19 preferably comprises concentrically disposed inner and outer tubes 24 and 26, respectively, adapted for slidable telescoping interengagement with one another. The extent of such telescoping interengagement defines the predetermined range of movement of first cross-bar 18 as mentioned hereinabove. One of the tubes 24 and 26, is rigidly fastened in a conventional manner to second post 16, while the other of the tubes is rigidly fastened in a conventional manner to first cross-bar 18. Preferably, as shown, outer tube 26 is fastened to second post 16, while inner tube 24 is fastened to first cross-bar 18. Inner tube 24 is provided with a series of parallel bores 28, each having a central axis 29, spaced along the length thereof and which extend through the inner tube in an orthogonal or transverse direction relative thereto. The number of bores 28 and distance by which each bore 28 is spaced from each other are predetermined to enable angle of incline α to be relatively precisely adjusted, preferably at increments of approximately 5 degrees or less, within the predetermined range of angles of incline, as will be discussed hereinafter. A bore 30, similar to bores 28, having a central axis 31, extends transversely through outer tube 26. Bores 28 and 30 are each provided with a predetermined diameter sufficient to permit a pin, such as cotter pin 32, to be slidably disposed therein. Inner tube 24 is thus telescopingly slidable relative to outer tube 28 throughout the range of movement of first cross-bar 18 to selectively axially or concentrically align bores 28 with bore 30, whereby cotter pin 32 may be simultaneously disposed in both aligned bores 28 and 30 to selectively secure inner tube 24 at a predetermined position relative to outer tube 26 as shown. In this manner, first cross-bar 18 is selectively maintained at a predetermined position within its predetermined range of movement.

Figure 6:
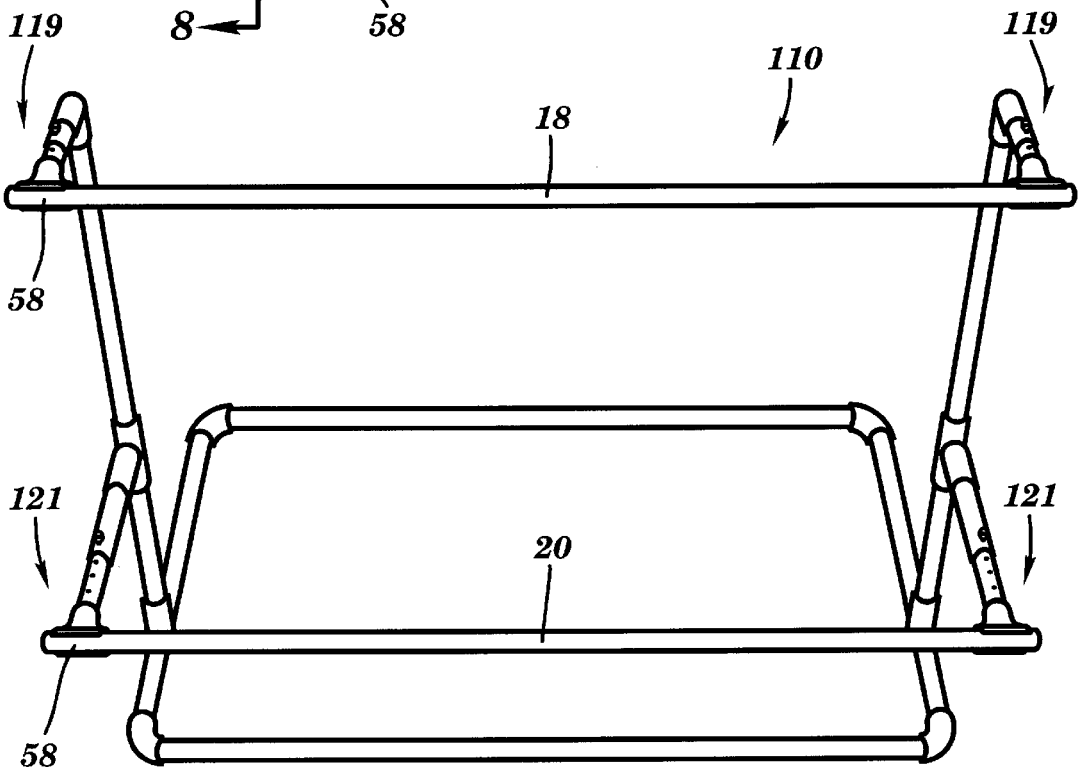
FIG. 6 is a perspective view of an alternate embodiment of a golf training aid of the present invention.

Referring now to FIG. 6, an alternate embodiment of the present invention is shown as golf training aid 110. Golf training aid 110 is substantially similar to golf training aid 10 with the exception that first and second fastener assemblies 19 and 21 have been replaced with first and second fastener assemblies 119 and 121, respectively. The following description of first fastener 119 will be understood to apply to second fastener 121 in nominally the same manner as the description of first fastener 19, hereinabove, applies to second fastener 21. Components of golf training aid 110 identical to those of golf training aid 10 will be given identical reference numerals, while similar components will utilize similar reference numbers. For explanatory purposes, the terms "rearward" and "forward" when used in connection with cross-bars 119 and 121 shall refer to directions heading generally towards and away from, respectively, the user's body, when the user is using golf training aid 110 in the manner shown in FIG. 5.

Figure 7:
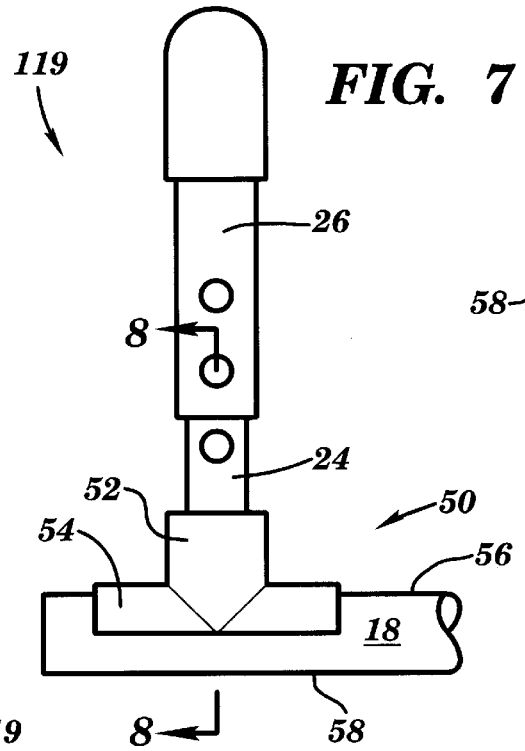
FIG. 7 is an enlarged, plan view of several components of a portion of the alternate embodiment of FIG. 6.
Figure 8:
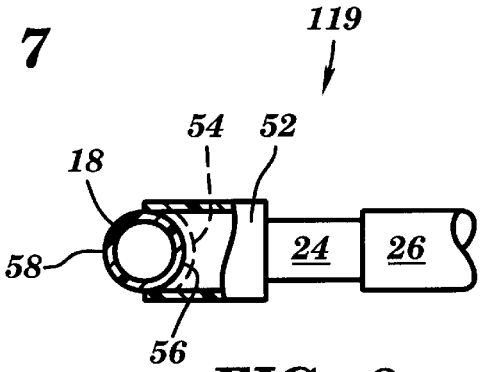
FIG. 8 is a partial cross-sectional view, with a portion thereof in phantom, of the alternate embodiment taken along 8—8 of FIG. 7.

Referring now to FIGS. 7 and 8, first fastener assembly 119 is substantially similar to first fastener assembly 19 with the exception that concentrically disposed inner and outer tubes 24 and 26, respectively, are fastened to first cross-bar 18 by a bar mount 50. Bar mount 50 includes a generally cylindrical neck portion 52 adapted to be rigidly fastened to one of the concentrically disposed inner and outer tubes 24 and 26. As shown, neck portion 52 is fastened to inner tube 24. Bar mount 50 also includes an elongated cross member portion 54 engaged with first cross-bar 18. Cross member portion 54 is preferably semi-cylindrical, having predetermined dimensions adapted to engage the cross-bar 18 in a superimposed or surface to surface manner with support surface 56 of the cross bar. As shown in FIGS. 7 and 8, support surface 56 comprises a rearward facing semi-cylindrical portion of the surface of cross-bar 18. Similarly, as shown in FIGS. 6–8, the forward facing semi-cylindrical portion of the surface of cross-bar 18 comprises shaft guiding surface 58 of the cross-bar.

This semi-cylindrical construction of cross member portion 54 thus serves to provide a relatively high surface-to-surface contact area with cross-bar 18 to provide a relatively secure union therewith, without necessitating engagement with any portion of shaft guiding surface 58. Such construction serves to leave shaft guiding surface 58 of the cross-bar nominally unobstructed throughout the length of the cross-bar. Advantageously, this configuration thus enables shaft 23 of a golf club to be guided in a substantially unobstructed manner along nominally the entire length of the cross-bar.

Preferred embodiments of the invention having been fully described, the following is a description of the operation thereof. As the operation of both embodiments described hereinabove is substantially identical, the following description will refer to the embodiment of golf training aid 10 with the understanding that the description applies substantially equally to the alternate embodiment of golf training aid 110.

Without cotter pins 32 installed, a user may initially move first and second guide members 18 and 20 within their predetermined ranges of movement, to selectively position notional surface s at a desired angle of incline α. This desired angle of incline α is one sufficient to maintain the club 22 at its proper orientation relative to the ball playing surface when in guiding contact with the cross-bars of training aid 10. As mentioned hereinabove, when training aid 10 is used on a relatively horizontal ball playing surface, angle of incline α is preferably chosen as nominally a complementary angle to angle β of the particular golf club 22 to be used, as shown in FIG. 3. Further adjustments may be made to angle of incline α as required in the event training aid 10 is used on non-horizontal ball playing surfaces. First and second guide members 18 and 20 are then moved as required, to axially align the nearest bore 28 with bore 30 of each fastener assembly 19. A cotter pin 32 may then be inserted therein to maintain the cross-bars in position. In this manner, notional surface s is maintained at an angle α which substantially represents the proper orientation of shaft 23 of golf club 22 relative to the ball playing surface during the practice stroke. As discussed hereinabove, the spacing between bores 28 is preferably sufficient to enable training aid 10 to be adjusted to an angle of incline α which is at least within approximately 5 degrees of the proper orientation of clubs 22 having a relatively wide range of shaft to head angles β. In this regard, the ability to adjust both first and second cross-bars 18 and 20 serves to provide an increased range of angles a to which notional surface s is adjustable, as compared to a similar configuration in which only one of the cross-bars were so movable.

Once the training aid 10 is so adjusted, a user may simply place a golf club 22 against the cross-bars as shown in FIGS. 3 and 5, and swing the club in a conventional manner, while maintaining such contact. Shaft 23 of the club may slide along cross-bars 18 and 20 during the stroke to thus be guided thereby. This guidance of the club during the golf stroke serves to help a golfer learn a consistent stroke by correct repeated motion.

When a different stroke is to be practiced, or when otherwise switching to a club having a different shaft to head angle β' such as that shown at 22' in FIG. 3, cross-bars 18 and 22 may be readjusted by removing cotter pins 32 and repeating the process described hereinabove. In this manner, the cross-bars will define a notional surface s' disposed at an alternate angle of incline α' as shown in FIG. 3.

As mentioned hereinabove, the construction of the present invention serves to maintain first and second guide members 18 and 20 at substantially uniform predetermined orthogonal distances a and b, respectively, from plane p, throughout their ranges of movability. Thus, when used on substantially horizontal ball playing surfaces, the present invention serves to support clubs 22 irrespective of the shaft to head angle β and angle of incline α, at substantially uniform heights. This helps provide a relatively uniform "feel" to the user even when alternately switching between clubs, such as between a putter and a chipping wedge.

Moreover, the distance between first and second cross-bars 18 and 20 is effectively increased as angle α decreases, such as from angle α' to angle a in FIG. 3. This increase in distance serves to broaden support to a club 22 as angle of incline α is decreased. Such broadened support serves to help offset any potential increase in the moment arm, or increased tendency of a club 22 to deviate from the preferred stroke, occasioned by a relative increase in shaft to head angle, such as from β' to β, as discussed hereinabove.

These features thus advantageously provide consistent, relatively stable support to a shaft 23 of a golf club 22 irrespective of the particular angle α chosen. Such stability and consistency helps to overcome the aforementioned problem of the shaft rocking or becoming disengaged from the guides during the stroke due to the bars either lowering relative to the user's hands, or moving closer to one another as the angle of incline $\alpha$ decreases. This added consistency provided by the present invention thus serves to improve the effectiveness of the present invention relative to the other aforementioned approaches.

A further advantage of the present invention is provided by the aforementioned rigid base 12. Such rigidity helps to maintain cross-bars 18 and 20 in parallel alignment with one another, regardless of angle of incline $\alpha$ chosen and regardless of minor inconsistencies in the topography of the ball playing surface over which base 12 is superimposed. Advantageously, such alignment serves to help prevent curved and/or misaligned "outside to in", or "inside to out" strokes.

A preferred embodiment of the training aid of the present invention is primarily adapted for aiding the relatively shorter strokes attendant to the game of golf, namely, chipping and putting strokes. However, the skilled artisan will also recognize that the present invention may be provided with relatively larger, curved cross-bars, as opposed to the substantially straight cross-bars 18 and 20 shown in the FIGS., to aid the practice of relatively longer golf strokes, without departing from the spirit and scope of the invention.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described the invention, what is claimed is:

1. A golf practice device for use with a golf club having a shaft extending between a handle and a head, a predetermined shaft to head angle, and the golf club being of sufficient size to enable a user standing substantially upright on a ball playing surface to swing the club for hitting a ball disposed proximate the user on the ball playing surface, said golf practice device comprising:

a base adapted for supportive contact with the ball playing surface;

first and second guide members supported by said base, said first and second guide members being adapted to slidably engage a portion of the club shaft located closer to the club handle than the club head and a portion of the club shaft located closer to the club head than the club handle along a notional surface defined by said first and second guide members, at least one of said first and second guide members being adapted for selective movement within a predetermined range of movement wherein said notional surface is selectively positionable at selected angles of incline relative to the ball playing surface so that said notional surface is positionable at an angle complementary to the shaft to head angle of the golf club, said selective movement being adapted to selectively increase distance between said first and second guide members as said selected angles of incline decrease.

2. The golf practice device of claim 1, wherein said notional surface is substantially planar.

3. The golf practice device of claim 1, wherein at least one of said first and second guide members are maintained at a substantially uniform predetermined orthogonal distance from the ball playing surface throughout said selective movement.

4. The golf practice device of claim 3, wherein both said first and second guide members are maintained at substantially uniform predetermined orthogonal distances from the ball playing surface throughout said selective movement.

5. The golf practice device of claim 4, wherein said base defines a notional plane and said first and second guide members are maintained at predetermined orthogonal distances from said notional plane throughout said selective movement.

6. The golf practice device of claim 4, wherein both said first and second guide members are adapted for said selective movement.

7. The golf practice device of claim 4, further comprising at least one support member extending from said base, said at least one support member being adapted to support said first and second guide members.

8. The golf practice device of claim 7, further comprising a pair of support members extending in a generally upright direction from said base and being adapted to support said first and second guide members.

9. The golf practice device of claim 8, wherein said first and second guide members extend in a direction substantially parallel to the ball playing surface.

10. The golf practice device of claim 8, wherein said first and second guide members each extend in a generally horizontal direction between said pair of support members.

11. The golf practice device of claim 1, wherein said first and second guide members are substantially straight.

12. The golf practice device of claim 1, wherein:

said first and second guide members each have a shaft guiding surface and a support surface, said shaft guiding surface and said support surface being disposed on opposite sides of each of said first and second guide members, each of said first and second guide members being supported by said base at said support surface so that said shaft guiding surface extends in an unobstructed manner along the entire length of each of said first and second guide members; and said shaft guiding surfaces of said first and second guide members are adapted to slidably engage the club shaft.

13. The golf practice device of claim 12, wherein each of said support surfaces is supported by at least one bar mount; said at least one bar mount having a cross member portion adapted for engagement with said support surface, and a neck portion adapted for engagement with said base.

14. The golf practice device of claim 1, further comprising at least one fastener assembly adapted to facilitate said selective movement.

15. The golf practice device of claim 14, wherein said at least one fastener assembly comprises a first tube and a second tube adapted for concentric and telescoping interengagement with one another, said first tube being fastened to said base and said second tube being fastened to at least one of said first and second guide members, said first tube and said second tube adapted for being selectively fastened to one another at a series of spaced locations along lengths thereof.

16. The golf practice device of claim 15, wherein both said first and second guide members are adapted for said selective movement, said golf practice device further comprising a plurality of fastener assemblies adapted to facilitate said selective movement.

17. A golf practice device for use with a golf club having a shaft extending between a handle and a head, a predetermined shaft to head angle, and the golf club being of sufficient size to enable a user standing substantially upright on a ball playing surface to swing the club for hitting a ball disposed proximate the user on the ball playing surface, said golf practice device comprising:

a base adapted for supportive contact with the ball playing surface;

first and second guide members supported by said base, said first and second guide members being adapted to slidably engage a portion of the club shaft located closer to the club handle than the club head and a portion of the club shaft located closer to the club head than the club handle along a notional surface defined by said first and second guide members, at least one of said first and second guide members being adapted for selective movement within a predetermined range of movement wherein said notional plane is positionable at selected angles of incline relative to the ball playing surface so that said notional surface is positionable at an angle complementary to the shaft to head angle of the golf club, and said first and second guide members are each maintained at substantially uniform predetermined orthogonal distances from the ball playing surface throughout said selective movement.

18. The golf practice device of claim 17, wherein both said first and second guide members are adapted for said selective movement.

19. A golf practice device for use with a golf club having a shaft extending between a handle and a head, a predetermined shaft to head angle, and the golf club being of sufficient size to enable a user standing substantially upright on a ball playing surface to swing the club for hitting a ball disposed proximate the user on the ball playing surface, said golf practice device comprising:

a base configured for supportive contact with a support surface, said base defining a notional base plane;

a pair of support members extending from said base;

first and second guide members supported by said support members, said first and second guide members being adapted to slidably engage a portion of the club shaft located closer to the club handle than the club head and a portion of the club shaft located closer to the club head than the club handle along a notional surface defined by said first and second guide members, said first and second guide members being adapted for selective movement within a predetermined range of movement wherein said notional surface is positionable at selected angles of incline relative to said notional base plane so that said notional surface is positionable at an angle complementary to the shaft to head angle of the golf club, while said first and second guide members are each maintained at uniform predetermined orthogonal distances from said notional base plane throughout said selective movement.

* * * * *